US005175467A

United States Patent [19]

Yamazaki et al.

[11] Patent Number: 5,175,467

[45] Date of Patent: Dec. 29, 1992

[54] FLAT DISPLAY PANEL ASSEMBLY

[75] Inventors: Fumio Yamazaki, Hirakata; Toshifumi Nakatani, Moriguchi; Seiichi Taniguchi, Osaka; Tetsuya Shiratori; Kiyoshi Hamada, both of Sakai; Kanji Imai, Takatsuki, all of Japan

[73] Assignee: Matsushita Electric Industrial Co., Ltd., Osaka, Japan

[21] Appl. No.: 741,614

[22] Filed: Aug. 7, 1991

[30] Foreign Application Priority Data

Aug. 10, 1990 [JP] Japan ..... 2-212870

[51] Int. Cl.[5] ..... H01J 29/70

[52] U.S. Cl. ..... 313/422; 313/421; 313/458; 313/460

[58] Field of Search ..... 313/421, 422, 495, 496, 313/497, 458, 460; 315/366

[56] References Cited

U.S. PATENT DOCUMENTS 4,118,651 10/1978 Scott ..... 313/422

5,017,842 5/1991 Hamada et al. ..... 313/422

*Primary Examiner*—Donald J. Yusko

*Assistant Examiner*—N. D. Patel

*Attorney, Agent, or Firm*—Wenderoth, Lind & Ponack

[57] ABSTRACT

A flat display panel assembly includes an evacuated glass envelope having a faceplate, a source of electron beams, a control electrode assembly including a stack of electrode substrates each having a predetermined pattern of electrode holes defined therein, and anodes formed by depositing phosphor material on the faceplate in correspondence with the electrode holes in the electrode substrates. At least one of the electrode substrates is made of a material having a coefficient of thermal expansion different from that of the remaining electrode substrates. The electrodes holes in such one of the electrode substrates are so defined and so arranged as to be offset from the corresponding electrode holes in the other electrode substrates by an increasing as a distance increases from a center portion of the electrode assembly towards the perimeter of the electrode assembly. With the electrode holes so defined and so arranged, the electrode substrates are movably supported to accomodate the thermal expansion.

9 Claims, 8 Drawing Sheets

Prior
Art

3 HOURS AFTER LIGHTING
GREEN
R G B R G B R G B
A
K

IMMEDIATELY AFTER LIGHTING
RED
BLUE
GREEN
RED-BLUE FADE
BLUE-GREEN FADE
G B R R G B B R G
SODA-LIME GLASS
G5'
SOFT-IRON
THERMAL EXP. COEFFICIENT AT 30-150°C.
SODA-LIME GLASS: 80 × 10^-7 METERS/(METERS × °C)
SOFT-IRON: 118 × 10^-7 METERS/(METERS × °C)
SUS 304: 173 × 10^-7 METERS/(METERS × °C)

3 HOURS AFTER LIGHTING
RED
RED-GREEN FADE
GREEN
BLUE-GREEN FADE
BLUE
B R G R G B R G B R
A
K

IMMEDIATELY AFTER LIGHTING
RED-GREEN FADE
GREEN
BLUE-GREEN FADE
G B R R G B B R G
A
SODA-LIME GLASS
SOFT-IRON
G5' - SUS 304
SOFT-IRON
K

FLAT DISPLAY PANEL ASSEMBLY

BACKGROUND OF THE INVENTION

1. Field of the Invention

The present invention generally relates to a flat display panel assembly of a type operable with electron beams and, more particularly, to an electrode structure used in the flat display panel assembly.

2. Description of the Prior Art

An exemplary prior art flat display panel assembly is shown in FIG. 9 in sectional representation. The prior art flat display panel assembly shown therein comprises an evacuated glass envelope open at one end and having a generally flat faceplate 50 opposite to the open end. The faceplate 50 has an inner surface formed with a phosphor deposited screen 51 in the form of a plurality of parallel stripes of phosphor material. The open end of the glass envelope is closed by a backup glass plate 53. Within the glass envelope, there is disposed a rear electrode 54, and a plurality of parallel cathodes 55 each in the form of a wire and serving as a source of electron beams. Each of the cathodes 55 extends generally parallel to the rear electrode 54 and is held under tension by means of spring retainers 56 and has its opposite ends connected to the associated spring retainer 56 and the rear electrode 54. Reference numerals 57, 58, 59 and 60 represent respective electron beam controlling electrodes positioned on one side of the cathodes 55 remote from the rear electrode 54 in a substantially stacked fashion. Each of the beam controlling electrodes 57 to 60 has a plurality of electrode holes 57*a*, 58*a*, 59*a* or 60*a* defined therein in a predetermined pattern for the passage of electron beams therethrough towards the phosphor deposited screen 51. An assembly of the beam controlling electrodes 57 to 60 is secured to the rear electrode 54 by means of a plurality of bond deposits 61 of bonding agent. It is to be noted that the electrode holes in each of the beam controlling electrodes 57 to 60 are aligned with the stripes of the phosphor deposited screen 51. Thus, when the cathodes 55 are heated, electron beams B are emitted therefrom and are, after having passed through the electrode holes in the beam controlling electrodes 57 to 60, impinged upon the stripes R, G and B of the phosphor deposited screen 51 to excite phosphor dots on the phosphor deposited screen 51. The electron beams B scan, while being deflected, a region S1 delimited between solid and phantom lines thereby to form a color image.

The prior art flat display panel assembly of the construction described above has the following problem. Since the beam controlling electrodes 57 to 60 and the rear electrode 54 tend to undergo a thermal expansion under the influence of heat radiation from the cathodes during an operation of the flat display panel assembly, the electrode assembly as a whole increases in size. This will now be discussed in detail. FIGS. 10 and 11 show a right-hand portion of the flat display panel assembly of FIG. 9 on an enlarged scale in different conditions, respectively. Specifically, FIG. 10 shows a condition of landing of the electron beams before the electrode assembly undergoes the thermal expansion, whereas FIG. 11 shows a condition of the electron beam landing after the thermal expansion of the electrode assembly. As shown in FIG. 10, the electron beams having passed through the electrode holes 60*a* in one of the beam controlling electrodes which is closest to the phosphor deposited screen 51 scan, while being deflected, an end region S1. If the electrode assembly undergoes the thermal expansion under the influence of the heat radiation from the cathodes 55 as discussed above, the region at which the electron beams land varies as indicated by S2 in FIG. 11 and a mislanding occurs in which the electron beams no longer scan predetermined phosphor stripes at a periphery of the phosphor screen 51. Once this mislanding occurs, a color distortion occurs accompanied by a reduction in image quality.

FIGS. 12 and 13 illustrate different modes of thermal expansion occurring in the prior art flat display panel assembly. Specifically, FIG. 12 illustrates the mode of thermal expansion which occurs when a center pin 15-1 which is located in alignment with a geometric center of the electrode assembly is fixed. On the other hand, if a pin 15-2 which is located adjacent one end of the electrode assembly is fixed, the mode of thermal expansion occurring in the electrode assembly is such as shown in FIG. 13. FIGS. 12 and 13 make it clear that, in either case, the pins extending loosely through the electrode holes are laterally offset relative to those electrode holes.

SUMMARY OF THE INVENTION

Accordingly, the present invention is intended to provide an improved flat display panel assembly effective to substantially eliminate a mislanding of electron beams on the phosphor deposited screen.

To this end, in accordance with the present invention, there is provided an improved flat display panel assembly which comprises an evacuated glass envelope having a faceplate, a source of electron beams, a control electrode assembly including a stack of electrode substrates each having a predetermined pattern of electrode holes defined therein, and anodes formed by depositing phosphor material on the faceplate in correspondence with the electrode holes in the electrode substrates. At least one of the electrode substrates is made of a material having a coefficient of thermal expansion different from that of the remaining electrode substrates. The electrode holes in such one of the electrode substrates are so defined and so arranged as to offset from the corresponding electrode holes in the other electrode substrates as a distance increases from a center portion of the electrode assembly towards the perimeter of the electrode assembly. With the electrode holes so defined and so arranged, the electrode substrates are movably supported for accommodating the thermal expansion.

According to the present invention, while some of the electrode holes in the electrode substrates which are located at a central region of the electrode assembly are aligned with each other, some of the electrode holes in the electrode substrate which are located at a region of the electrode assembly other than the central region thereof are offset from each other. The amount of such offset between the electrode holes in the electrode substrate progessively increases as the distance from the center of the electrode assembly increases. Also, at least one of the electrode substrates which has the electrode holes offset from those of the electrode holes in the other electrode substrates is made of a material having a greater coefficient of thermal expansion than that of the other electrode substrates. With such a design, the amount of relative offset between the electrode holes can vary from the central region to the peripheral region of the electrode assembly in response to an increase in temperature. Therefore, a center angle of deflection of the electron beams varies with an increase in temperature to thereby to permit the electron beams to scan a predetermined position on the phosphor screen.

BRIEF DESCRIPTION OF THE DRAWINGS

This and other objects and features of the present invention will become clear from the following description taken in conjunction with a preferred embodiment thereof with reference to the accompanying drawings, in which.

DETAILED DESCRIPTION OF THE EMBODIMENT

Figure 1:
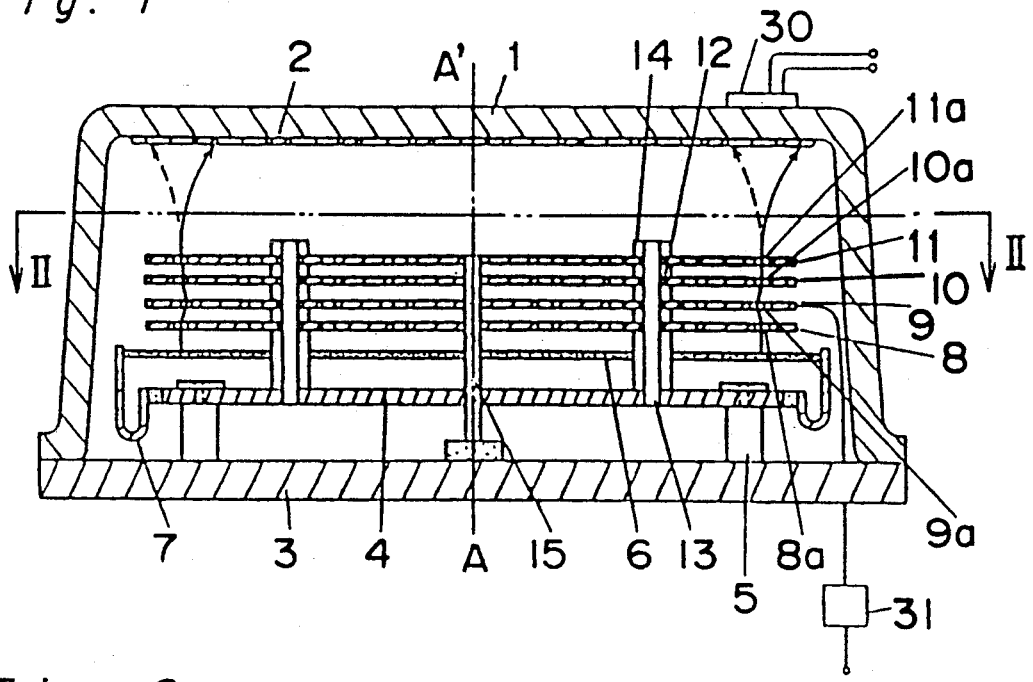
FIG. 1 is a side sectional view of a flat display panel assembly embodying the present invention.

Referring first to FIG. 1, a flat display panel assembly shown therein comprises an evacuated glass envelope open at one end and having a generally flat faceplate 1 opposite to the open end. The faceplate 1 has an inner surface formed with a phosphor deposited screen 2 in the form of a plurality of parallel stripes of phosphor material which act as anodes. The open end of the glass envelope is closed by a backup container (or rear plate) 3 forming a part of the evacuated envelope. Within the evacuated envelope, there is disposed a rear electrode 4 fixedly mounted on posts 5 protruding from the rear plate 3. This rear electrode 4 is slidably retained by the posts 5 so that it can move when it undergoes a thermal expansion. A plurality of parallel cathodes 6 each being in the form of a wire are held under tension by means of spring retainers 7 each having its opposite ends connected with the rear electrode 4 and the adjacent end of the associated cathode 6, respectively. An electrode assembly includes an electron beam drawing electrode 8, a first control electrode 9, a second control electrode 10 and a third control electrode 11 which are stacked one above the other. A line A—A' drawn perpendicular to the electrode assembly represents a center line passing through geometrical centers of those electrodes 8 to 11.

Referring numeral 12 represents spacers made of electrically insulating material and interposed between each pair of neighboring electrodes 8 to 11. The electrodes 8 to 11 are mounted on a plurality of pins 13 formed of electrically insulating material, and are fixed in position by means of fixing rings 14 press-fitted onto the pins 13 while the spacers 12 are interposed between the electrodes 8 and 9, between the electrodes 9 and 10, and between the electrodes 10 and 11. Respective ends of the pins 13 remote from those receiving the fixing rings 14 are rigidly secured to the rear electrode 4.

Each of the electrodes 8 to 11 has a plurality of electrode holes 8*a*, 9*a*, 10*a* or 11*a* defined therein in a predetermined pattern. The electrode holes 8*a*, 10*a* and 11*a* of the drawing electrode 8, the second control electrode 10 and the third control electrode 11 are aligned with each other. Also, predetermined positions on the phosphor deposited screen 2 correspond with those electrode holes. In the illustrated embodiment, a region of the phosphor deposited screen 2 which include three stripes is adapted to be scanned by a single electron beam.

Reference numeral 15 represents a standard post, used during a fabrication of the electrode assembly, onto which the electrodes 8 to 11 are mounted. Thermal expansion of the electrodes may take place around this standard post 15. Reference numeral 30 represents a photosensor which forms a detecting means for detecting an electron beam scanning position, and reference numeral 31 represents a voltage controlling means. The scanning position of the electron beams can be controlled by adjusting, with the use of the voltage controlling means 31 through a well-known feedback technique, a voltage to be applied to the control electrodes in dependence on a change in scanning position of the electron beams detected by the photosensor 30.

Figure 2:
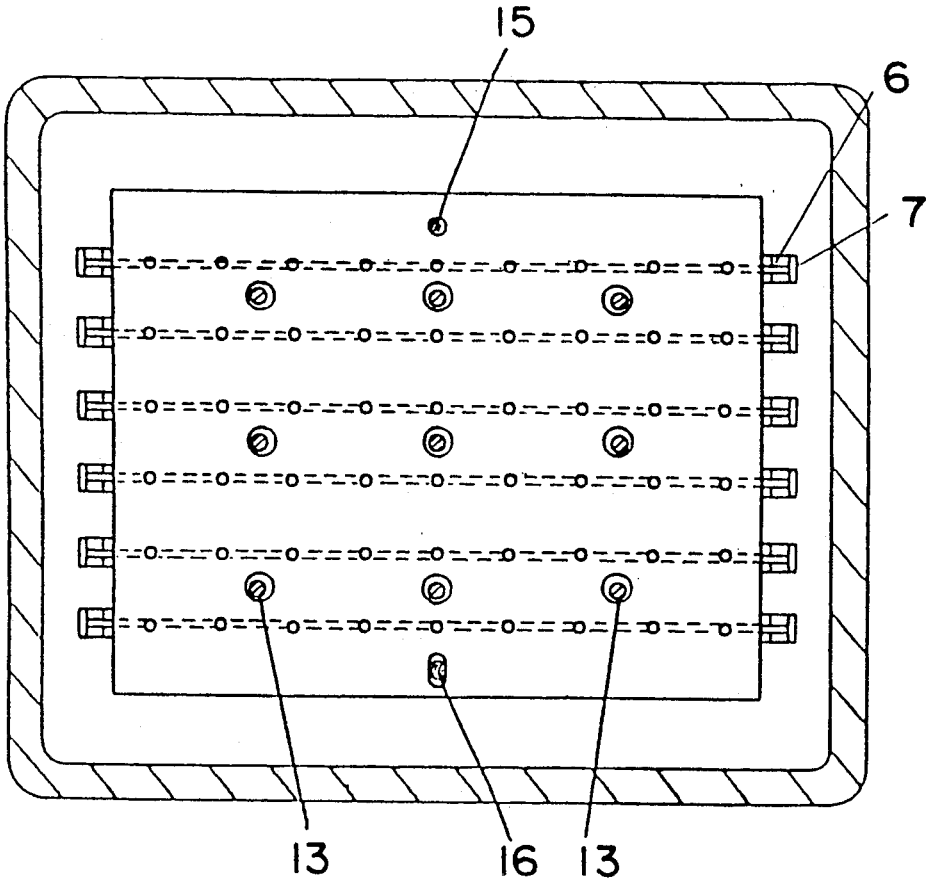
FIG. 2 is a cross-sectional view, taken along the line II—II in FIG. 1.

In the illustrated embodiment, referring now to FIG. 2 showing a cross-section taken along the line II—II in FIG. 1, in addition to the standard post 15, a regulating post 16 is employed to avoid any possible rotation of the electrode assembly. However, the electrode assembly is slidable relative to the regulating post 16. The electrodes 8 to 11 of the electrode assembly are mounted on the pins 13 which loosely extend through perforations (or pin holes) defined in each of the electrodes 8 to 11. Each of the perforations is sized so that none of the pins 13 will contact any of the electrodes 8 to 11, even when the thermal expansion takes place. It is to be noted that, although the standard post 15 has been shown as positioned adjacent one of opposite sides of the electrode assembly, it may be positioned in alignment with a central area of the electrode assembly.

Figure 3:
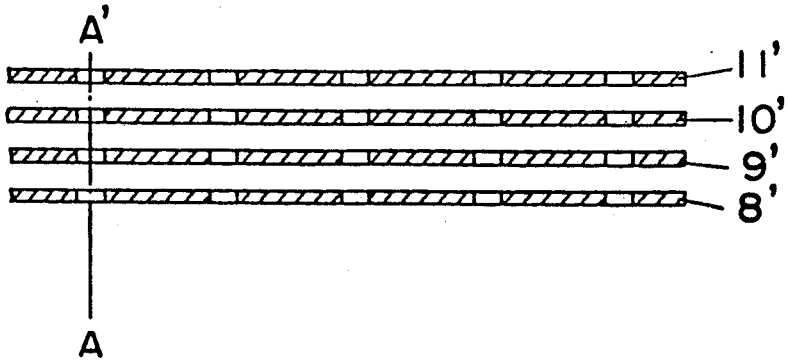
FIG. 3 is a sectional view of an electrode assembly used in the prior art flat display panel assembly, in which electrode holes are all aligned with each other.
Figure 4:
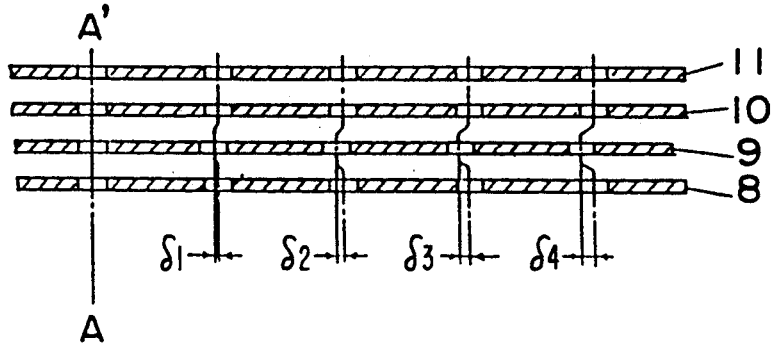
FIG. 4 is a view similar to FIG. 3, showing an electrode assembly used in the flat display panel assembly according to the present invention, in which the electrode holes in one of the electrodes of the electrode assembly are offset relative to those in the other electrodes.

In the prior art flat display panel assembly the electrode holes in the electrodes forming the electrode assembly are aligned with each other as shown in FIG. 3. However, in the practice of the present invention, as best shown in FIG. 4, one of the electrodes 8 to 11, specifically, the first control electrode 9, has its electrode holes 9*a* offset a predetermined distance δ in a direction inwardly (i.e. toward the center line A—A') thereof relative to the electrode holes 8*a*, 10*a* or 11*a* in any one of the remaining electrodes 8, 10 and 11. The offset quantity δ progressively increases as the distance away from the geometric center of the first control electrode 9 increases, i.e., ($\delta 1<\delta 2<\delta 3<\delta 4$). The first electrode 9 is, according to the present invention, made of stainless steel having a greater coefficient of thermal expansion than that of any one of the remaining electrodes 8, 10 and 11 which are made of soft-iron.

The electrodes 8 to 11 are supported so as to be slidable relative to the spacers 12 mounted on the pins 13. The difference in coefficients of thermal expansion between the first control electrode 9 and any one of the remaining electrodes 8, 10 and 11 may be chosen in consideration of the amount of mislanding, that is, the amount of deviation of the electron beams, which may occur under the influence of the thermal expansion.

Figure 5:
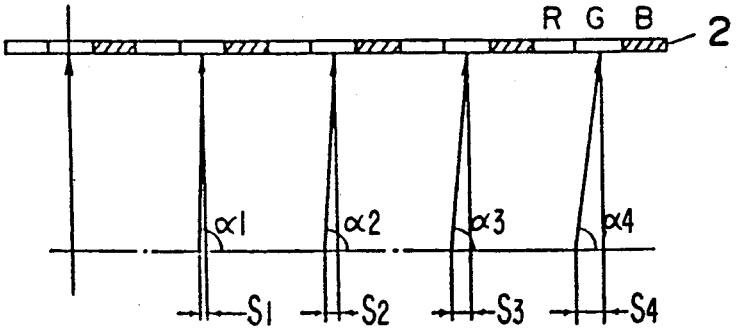
FIG. 5 is a diagram showing how electron beams are deflected before a thermal expansion in the flat display panel assembly according to the present invention.

FIG. 5 illustrates a center angle α of deflection of each electron beam relative to the phosphor deposited screen 2. As shown therein, the center angle α1 of deflection of the electron beam travelling close to the geometric center of the electrode assembly is smaller than the center angle α2 of deflection of the electron beam travelling remote from the geometric center of the electrode assembly and close to the perimeter of the electrode assembly. In other words, the center angles α of deflection of the electron beams progressively increase with an increase in distance away from the geometric center of the electrode assembly, with the electrode holes being offset a distance S inwardly thereof as compared with those in the prior art electrode assembly.

Figure 6:
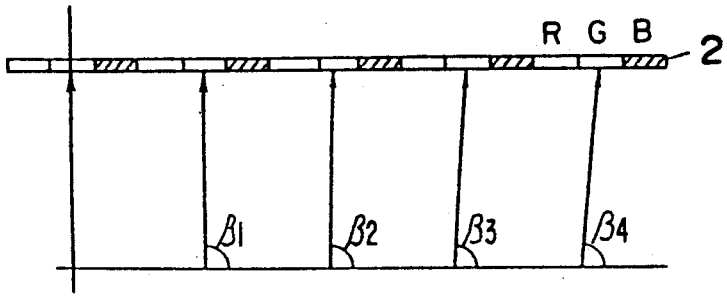
FIG. 6 is a diagram showing how electron beams are deflected after the thermal expansion in the flat display panel assembly according to the present invention.

FIG. 6 illustrates a center angle β of deflection of the electron beam which is exhibited relative to the phosphor deposited screen 2 when the electrode is thermally expanded under the influence of radiant heat generated by the cathodes. The thermal expansion of the electrode results in a displacement of the position of the electrode holes towards the perimeter of the electrode assembly and, therefore, the center angle β of deflection after the thermal expansion is increased relative to the center angle α of deflection before the thermal expansion of the electrode. The center angle of deflection depends on the quantity δ of relative deviation of the electrode holes and may be a relatively small value if the quantity δ of deviation is relatively large.

Thus, since the coefficient of thermal expansion of the first control electrode 9 is chosen to be greater than that of the other electrodes opposed thereto, the quantity δ of deviation of the electrode holes in the first control electrode 9 relative to the electrode holes in any one of the electrodes opposed thereto decreases (i.e. the distance by which the electrode holes 9*a* are offset relative to the electrode holes 8*a*, 10*a*, and 11*a* decreased), as the temperature of the electrode assembly as a whole increased, and therefore, the center angles of deflection of the electron beams increase. Because of this, the scanning position of the electron beam shifts relative to the phosphor deposited screen 2 in a direction inwardly toward the outer line A—A'. Thus, the coefficient of thermal expansion of each of the electrodes and the amount of deviation of the electrode holes in such electrode can be so selected as to counterbalance with the amount of deviation in scanning position of the electron beam resulting from the thermal expansion of the electrode.

By way of example, assuming that the distance from the geometric center A—A' of the electrode assembly to the perimeter thereof is 160 millimeters; the coefficient of thermal expansion of the electrodes 8, 10, and 11 is $140\times10^{-7}$E; the power of deflection at the position of the phosphor deposited screen relative to the amount of deviation of the electrode holes is 3.5; and the amount δ4 of deviation of the electrode holes is 38 microns; the coefficient of thermal expansion of the first control electrode 9 (SUS 304) is $180\times10^{-7}$E; and the amount of increase in temperature of the electrode assembly is 60° C., it will be found that, after the increase of the temperature of the electrode assembly, the amount of thermal expansion of the first control electrode is 0.172 mm, and the amount of thermal expansion of the electron beam drawing electrode is 0.134 mm, with a difference therebetween being 38 microns, such that the amount δ4 of deviation of the electrode hole is zero. Therefore, the phosphor stripes at the same position as the initial scanning position of the electron beam can be radiated. A condition in which the electron beam impinges upon the phosphor deposited screen before the temperature increases is shown in FIG. 7 while that after the temperature has increased is shown in FIG. 8.

Figure 7:
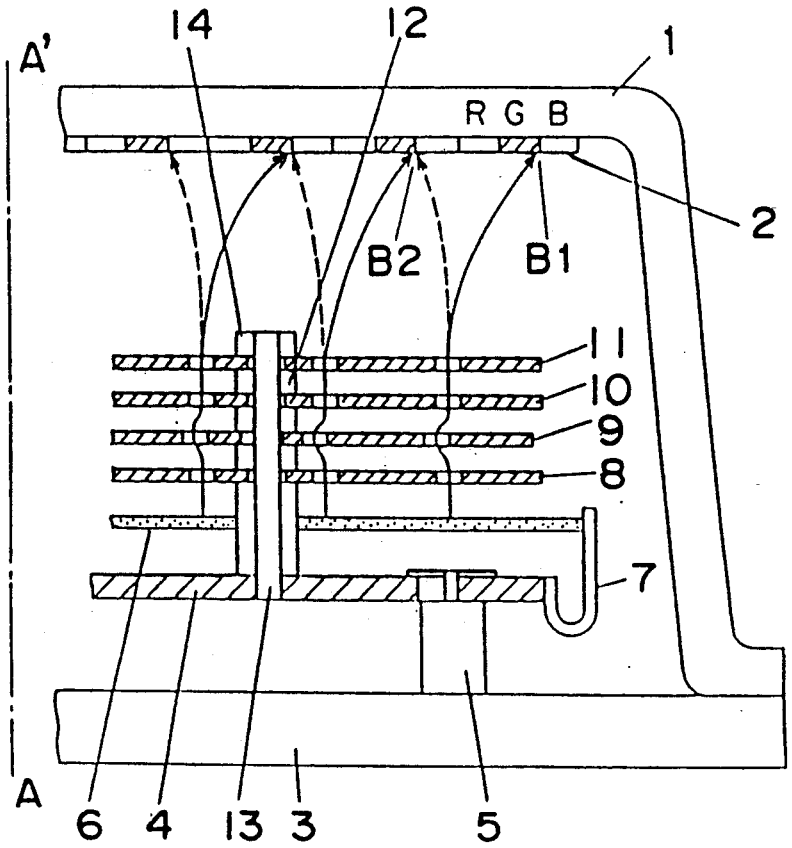
FIGS. 7 and 8 are side sectional views, on an enlarged scale, of a portion of the flat display panel assembly in different operating conditions, respectively.
Figure 8:
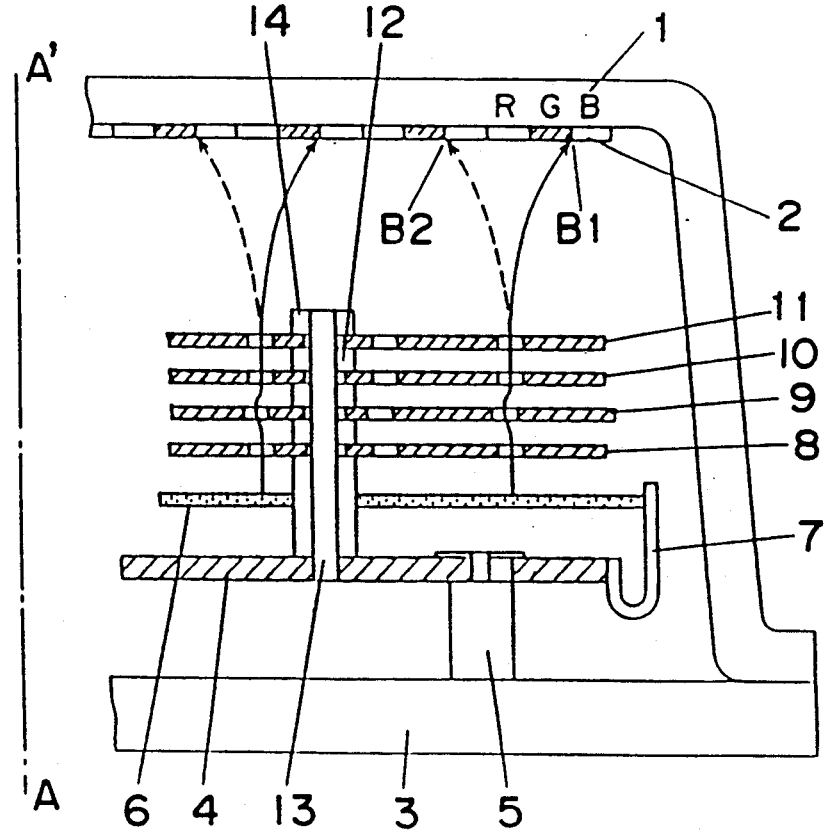
Figure 9:
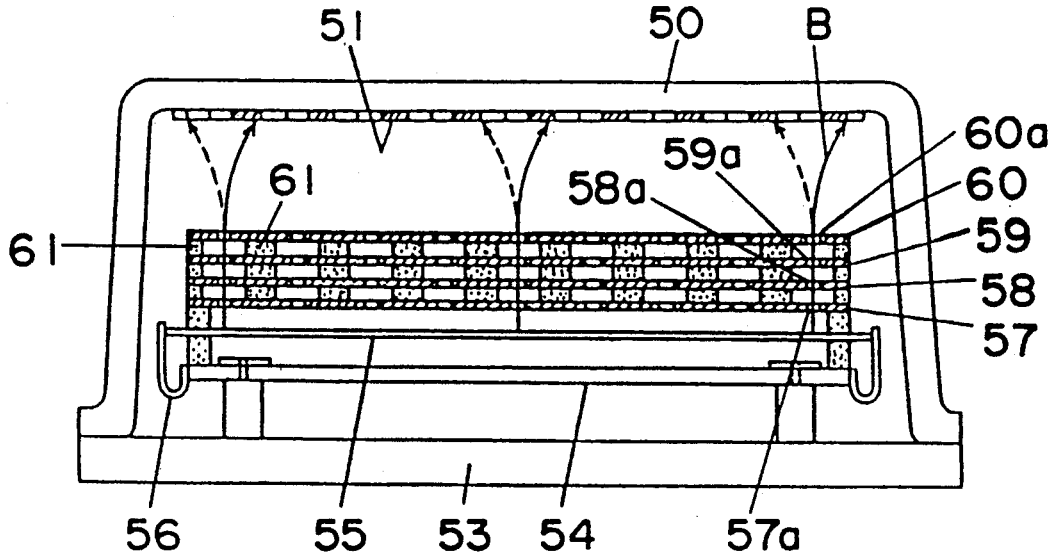
Fig. 9 Prior Art
FIG. 9 is a side sectional view of the prior art flat display panel assembly.
Figure 10:
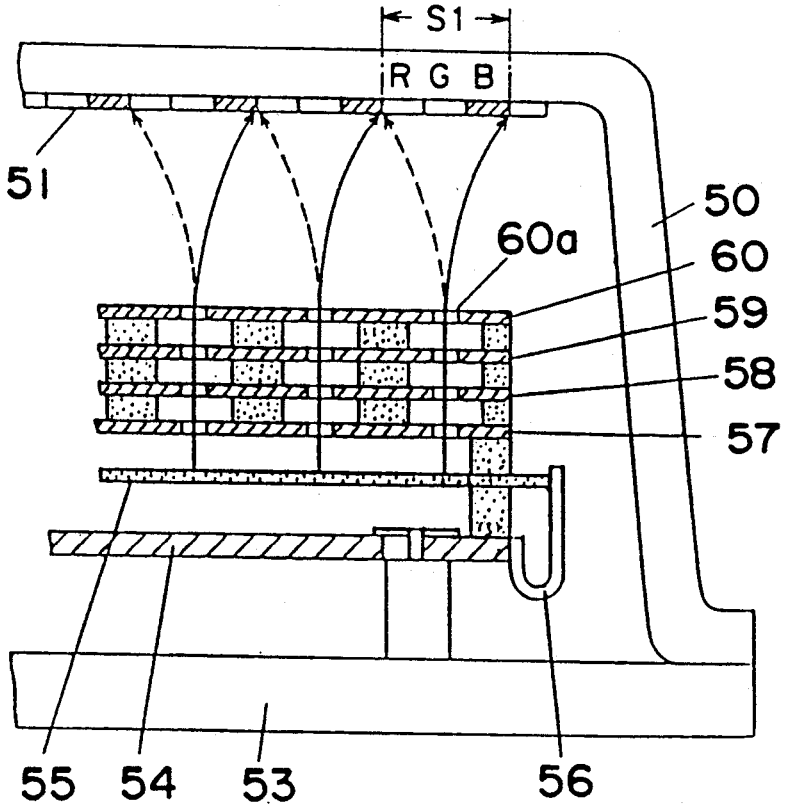
Fig. 10 Prior Art
FIGS. 10 and 11 are side sectional views, on an enlarged scale, of a portion of the prior art flat display panel assembly in the different operating conditions, respectively.
Figure 11:
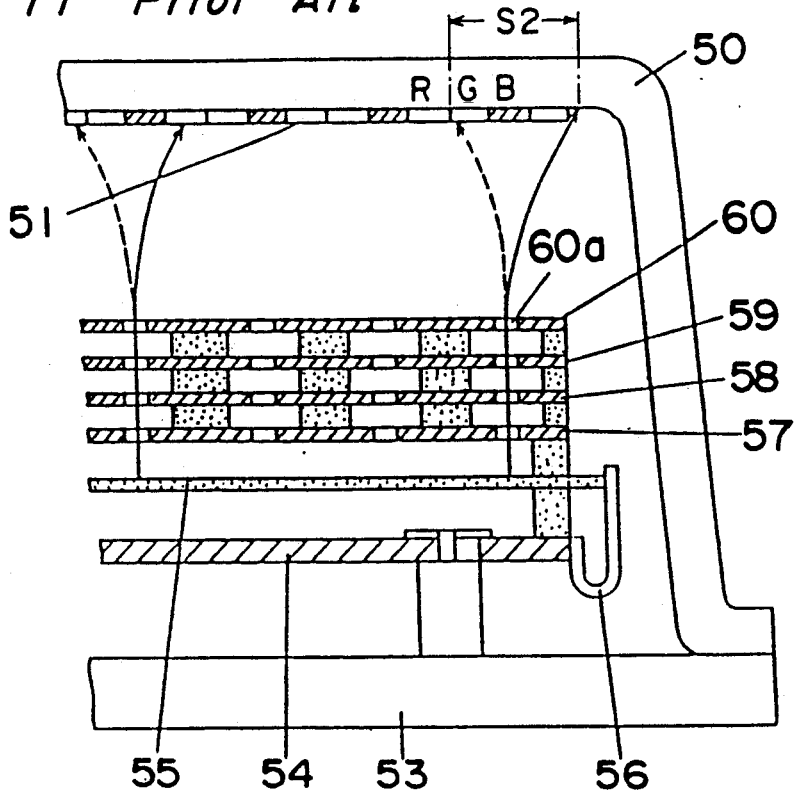
Fig. 11 Prior Art
Figure 12:
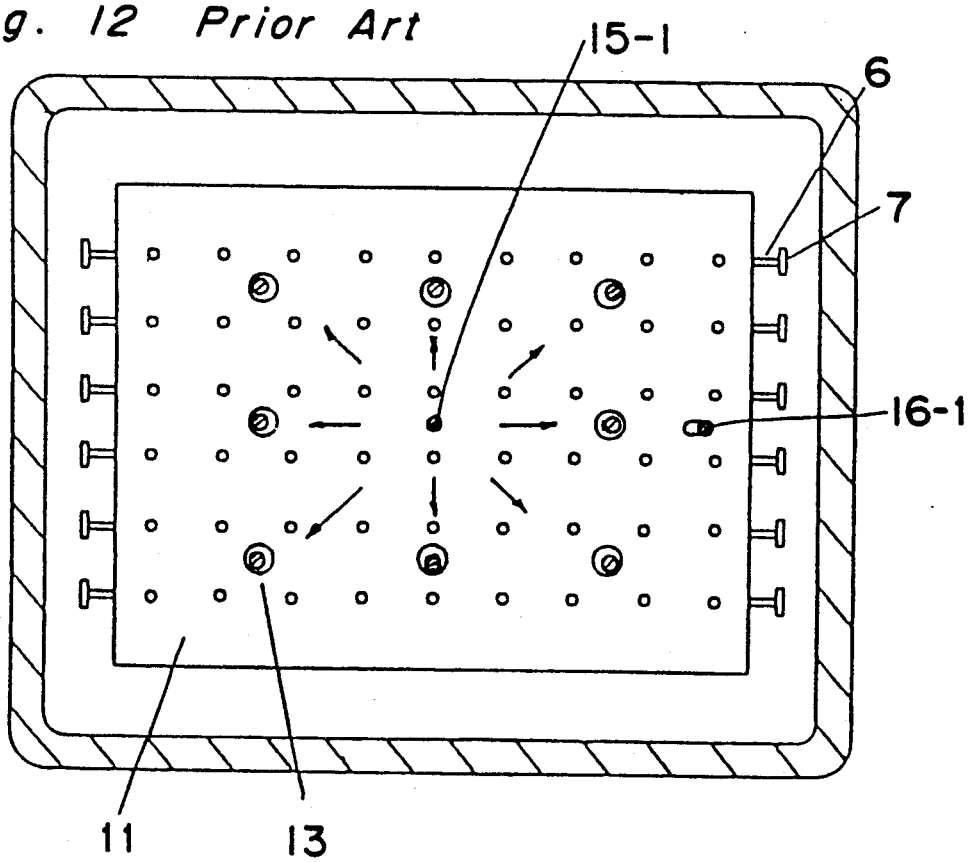
Fig. 12 Prior Art
FIGS. 12 and 13 are views similar to FIG. 2, but showing different modes of thermal expansion occurring in the prior art flat display panel assembly shown in FIG. 11, respectively.
Figure 13:
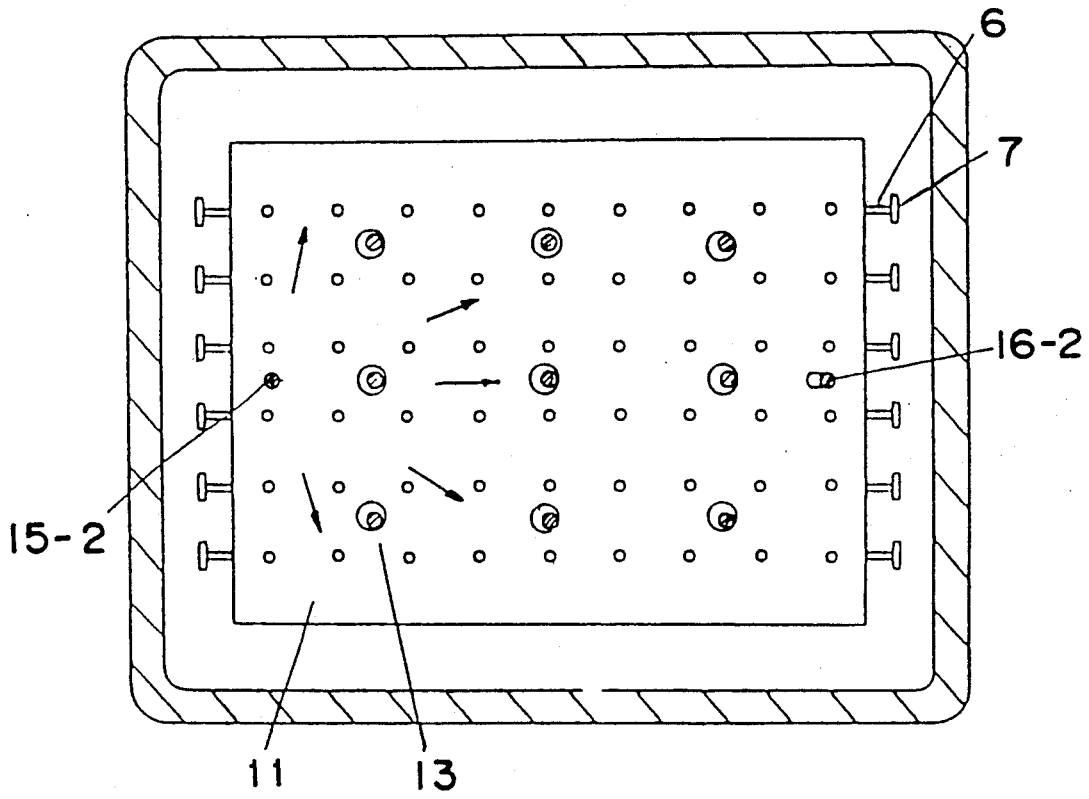
Fig. 13 Prior Art

A comparison of FIG. 8 with FIG. 7 makes it clear that, in either case, the electron beams 1 and at the same predetermined positions on the phosphor deposited screen 2. While in the illustrated embodiment the electrode holes in the first control electrode 9 have been shown and described as being displaced, the electrode holes in one of the remaining electrodes may be shifted in position, provided that a horizontal deflection is possible and focusing characteristics of the electron beams can be satisfied.

Figures 14A, 14B:
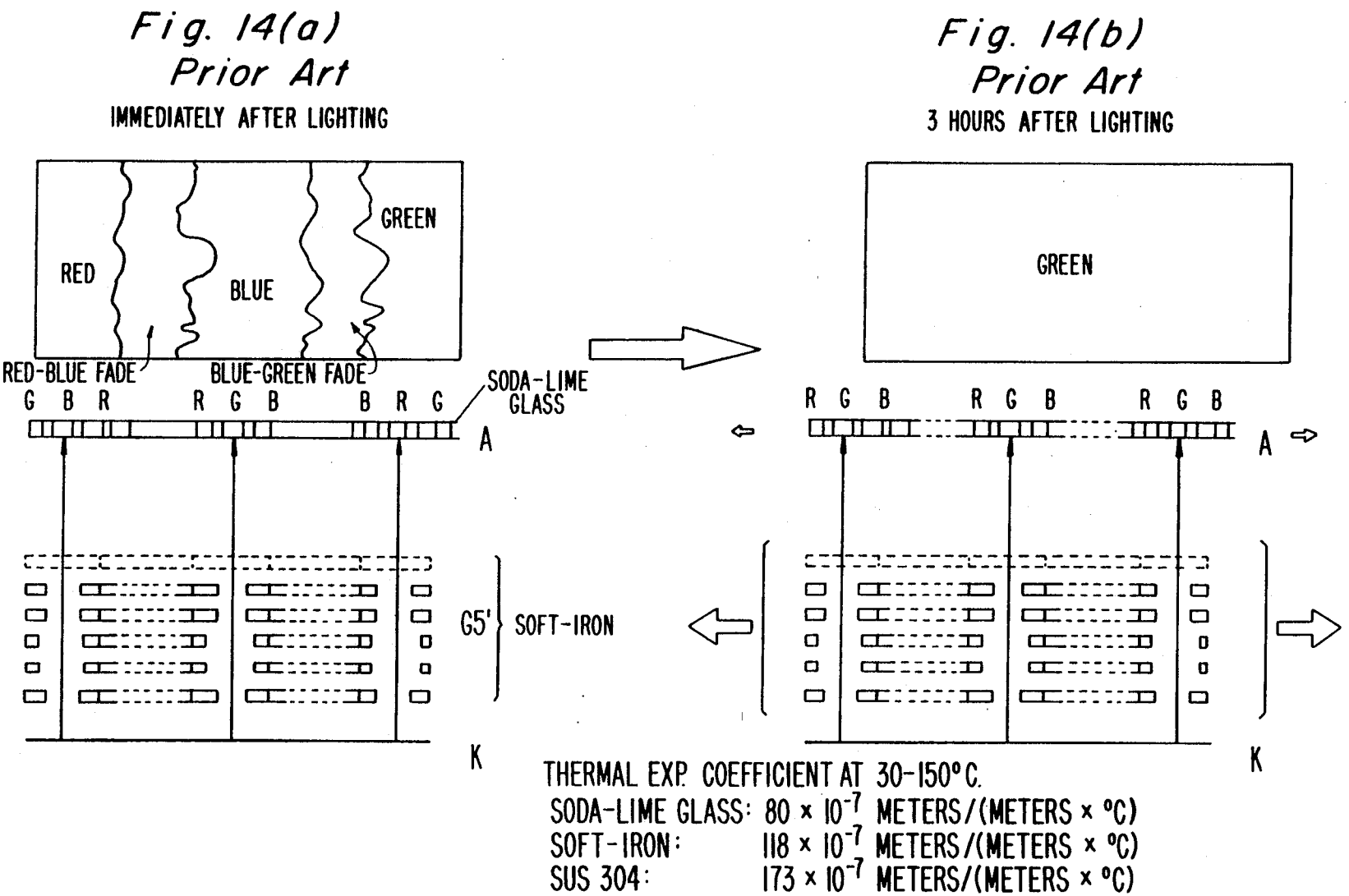
Fig. 14(b) Prior Art
Fig. 14(a) Prior Art
FIGS. 14(*a*) and 14(*b*) are color photographs showing a representations of color display exhibited by the prior art flat display panel assembly immediately and 3 hours after it has been lit, respectively.
Figures 15A, 15B:
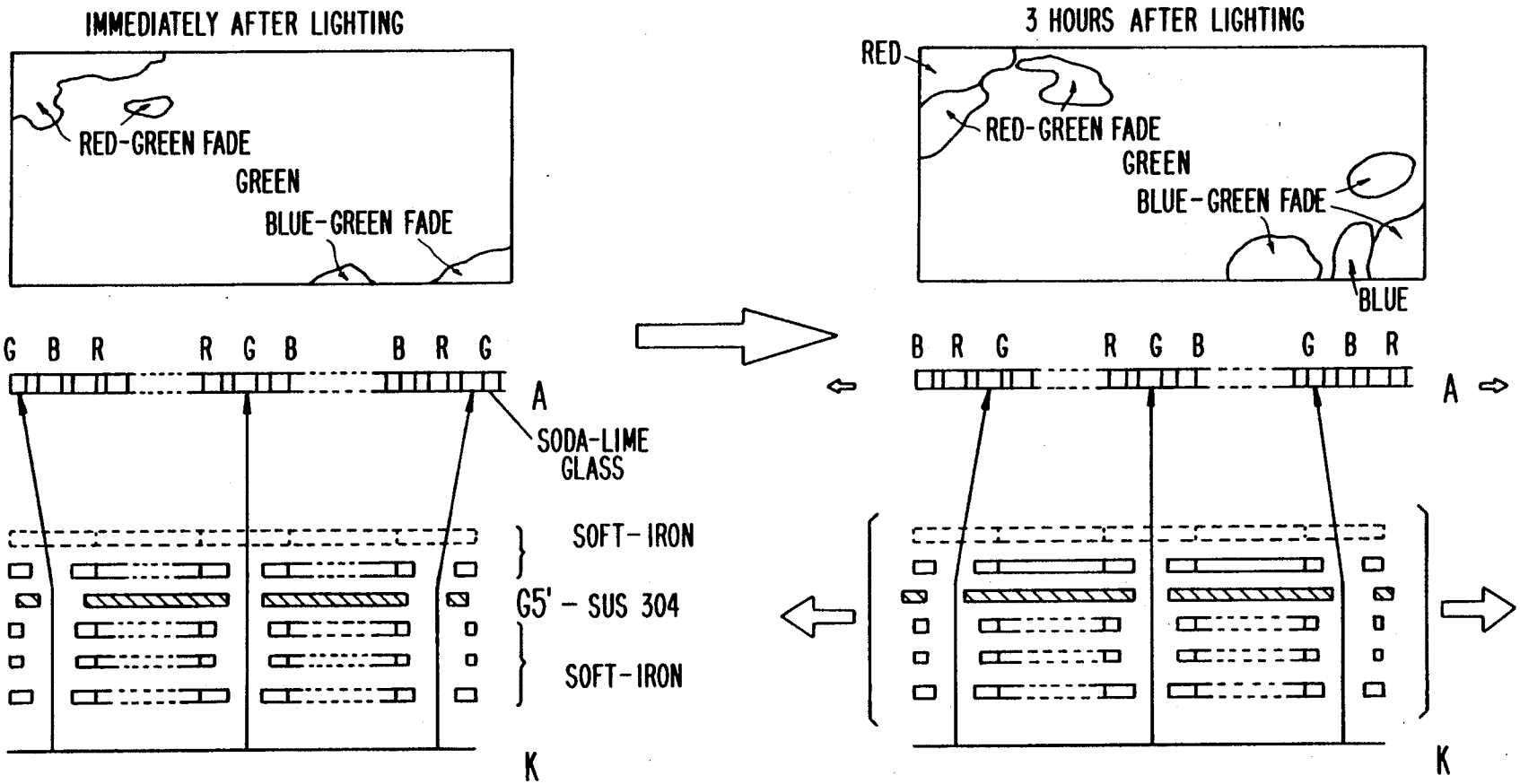
FIGS. 15(*a*) and 15(*b*) are representations of color photographs showing a color display exhibited by the flat display panel assembly of the present invention immediately and 3 hours after it has been lit, respectively

FIGS. 14 and 15 illustrate respective results of experiments conducted to demonstrate how an irregular color reproduction found in the prior art flat display panel assembly has been improved by the present invention. During those experiments, a soda-lime glass having a thermal expansion coefficient of $80\times10^{-7}$ /°C. a sort-iron having a thermal expansion coefficient of $118\times10^{-7}$/°C. and SUS 304 having a thermal expansion coefficient of $173\times10^{-7}$/°C. were employed. FIG. 14(*a*) and FIG. 15(*a*) show color display conditions exhibited by the prior art flat panel display assembly and the flat panel display assembly of the present invention, respectively, immediately after they have been lit, whereas FIG. 14(*b*) and FIG. 15(*b*) show respective color display conditions exhibited thereby 3 hours after they have been lit. It will readily be seen from a comparison between FIGS. 14 and 15 that the flat display panel assembly according to the present invention is superior to that according to the prior art.

From the foregoing description, it is clear that the present invention is effective to provide the flat display panel assembly substantially free from a reduction in image quality which would occur as a result of mislanding of the electron beam due to thermal expansion of the electrodes under the influence of the radiant heat from the cathodes. It is also clear that the flat display panel assembly embodying the present invention does not require the use of any temperature detecting device hitherto necessitated to permit the electrode to automatically compensate for a mislanding.

Also, the present invention employs a slidable structure for the electrodes in which the electrodes can slide relative to each other and, accordingly, as compared with the electrode assembly wherein no relative sliding motion of the electrodes is permitted, an increased amount of correction of the mislanding can be obtained. In addition, where a feedback control means is employed for the detection of the scanning position of the electron beams, a highly precise correction is possible and, therefore, the flat display panel assembly capable of providing a high quality image reproduction can be realized.

Although the present invention has been described in connection with the preferred embodiment thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A flat display panel assembly comprising:

an evacuated glass envelope having a faceplate;

a source of electron beams;

an electrode assembly including a plurality of electrode substrates, each of which has a plurality of electrode holes formed therein in a predetermined pattern to allow the electron beams to pass therethrough;

mounting means for mounting said plurality of electrode substrates in a vertically spaced apart stacked relationship such that said electrode substrates are horizontally movable relative to one another in such a manner as to allow for thermal expansion of said electrode substrates relative to one another;

a plurality of anodes, formed of phosphor material deposited as stripes along said faceplate, which correspond with respective ones of said plurality of electrode holes formed in said electrode substrates;

wherein at least one of said plurality of electrode substrates is formed of a material having a coefficient of thermal expansion different than remaining ones of said plurality of electrode substrates, such that said at least one of said plurality of electrode substrates expands horizontally to a different degree than said remaining ones of said plurality of electrode substrates upon an increase in the temperature of said plurality of electrodes; and wherein said electrode holes of said at least one of said plurality of electrode substrates are arranged so as to be offset relative to corresponding electrode holes of said remaining ones of said plurality of electrode substrates by a distance which increases as a distance away from a predetermined horizontal location increases.

2. A flat display panel assembly as recited in claim 1, wherein said electrode substrates are fixed against horizontal movement relative to one another at said predetermined horizontal location, such that thermal expansion of said electrode substrates causes expansion thereof away from said predetermined horizontal location.

3. A flat display panel assembly as recited in claim 2, wherein said predetermined horizontal location is at a first horizontally central position along one horizontal direction of said plurality of electrode substrates.

4. A flat display panel assembly as recited in claim 3, further comprising a regulating post, for preventing rotation of said electrode substrates about said predetermined horizontal location, extending vertically through said plurality of electrode substrates at a second horizontally central position along said one horizontal direction of said plurality of electrodes substrates, said second horizontally central position being horizontally spaced from said first horizontally central position in a direction perpendicular to said one horizontal direction.

5. A flat display panel assembly as recited in claim 1, further comprising a standard post extending vertically through said plurality of electrode substrates at said predetermined horizontal location, such that said electrode substrates are fixed against horizontal movement relative to one another at said predetermined location and thermal expansion of said electrode substrates causes expansion away from said predetermined horizontal location.

6. A flat display panel assembly as recited in claim 5, wherein said predetermined horizontal location is at a first horizontally central position along one horizontal direction of said plurality of electrode substrates.

7. A flat display panel assembly as recited in claim 6, further comprising a regulating post, for preventing rotation of said electrode substrates about said standard post, extending vertically through said plurality of electrode substrates at a second horizontally central position along said one horizontal direction of said plurality of electrodes substrates, said second horizontally central position being horizontally spaced from said first horizontally central position in a direction perpendicular to said one horizontal direction.

8. A flat display panel assembly as recited in claim 1, wherein said at least one of said plurality of electrode substrates has a coefficient of thermal expansion which is higher than said remaining ones of said plurality of electrode substrates, such that said at least one of said plurality of electrode substrates is subject to a greater degree of expansion than said remaining one of said plurality of electrode substrates when the temperature of said plurality of electrode substrates is increased, and such that thermal expansion of said plurality of electrode substrates causes said distance by which each of said electrode holes of said at least one of said plurality of electrode substrates is offset relative to each of said corresponding electrode holes of said remaining ones of said plurality of electrode substrates to decrease.

9. A flat display panel assembly as recited in claim 1, further comprising an electron beam scanning position detecting means for detecting scanning positions of the electron beams relative to said plurality of anodes, respectively; and an electron beam controlling means for controlling the scanning positions of the respective electron beams in dependence on information from said electron beam scanning position detecting means.

* * * * *